US005857778A

United States Patent [19]

Ells

[11] Patent Number: 5,857,778

[45] Date of Patent: Jan. 12, 1999

[54] COLLAPSIBLE THERMAL INSULATING CONTAINER

[76] Inventor: James R. Ells, 7116 Stinson Ave. B-311 224, Gig Harbor, Wash. 98335

[21] Appl. No.: 719,324

[22] Filed: Sep. 25, 1996

[51] Int. Cl.[6] ..... B65D 33/34

[52] U.S. Cl. ..... 383/5; 383/110; 383/119

[58] Field of Search ..... 383/110, 5, 4, 383/116, 119, 104; 150/901

[56] References Cited

U.S. PATENT DOCUMENTS

| | | | |
|---|---|---|---|
| Re. 34,533 | 2/1994 | Wigley . | |
| 1,735,832 | 11/1929 | Martin . | |
| 1,971,395 | 8/1934 | Danner | 383/110 X |
| 2,017,469 | 10/1935 | McKee et al. . | |
| 2,087,966 | 7/1937 | Clark . | |
| 2,725,087 | 11/1955 | Potter . | |
| 3,031,121 | 4/1962 | Chase | 383/110 X |
| 3,152,915 | 10/1964 | Cover et al. . | |
| 3,425,472 | 2/1969 | Marino . | |
| 3,667,598 | 6/1972 | Zelnick et al. . | |
| 3,685,233 | 8/1972 | Lassig et al. . | |
| 4,091,852 | 5/1978 | Jordan et al. | 383/110 X |
| 4,509,645 | 4/1985 | Hotta | 383/110 X |
| 4,537,313 | 8/1985 | Workman | 383/110 X |
| 4,598,746 | 7/1986 | Rabinowitz | 383/110 X |
| 4,838,418 | 6/1989 | Teixeira . | |
| 5,028,087 | 7/1991 | Ells . | |
| 5,100,016 | 3/1992 | Wischusen, III . | |
| 5,154,309 | 10/1992 | Wischusen, III et al. . | |

FOREIGN PATENT DOCUMENTS

| | | | |
|---|---|---|---|
| 2518504 | 6/1983 | France | 383/110 |
| 4201868 | 7/1992 | Japan | 383/110 |
| 2163724 | 3/1986 | United Kingdom | 383/110 |

*Primary Examiner*—Jes F. Pascua

*Attorney, Agent, or Firm*—Christensen O'Connor Johnson & Kindness PLLC

[57] ABSTRACT

A collapsible thermal insulating container (10) includes a bottom wall (14), side wall (16) and integral lid (20). The side wall is formed from hinged panels including fastener strips (36). The container can be disassembled to form a sheet which lies flat in a common plane. All walls and the lid of the container are constructed from a matrix including inner and outer radiant energy reflective laminates (44) and an air trapping laminated foam insulating layer (52) disposed therebetween. A rigidity imparting structural reinforcement layer (56) is also included in the panels of the sidewall, bottom wall and lid.

5 Claims, 5 Drawing Sheets

COLLAPSIBLE THERMAL INSULATING CONTAINER

FIELD OF THE INVENTION

The present invention relates to thermal insulation of materials which are to be stored or shipped at a temperature that is above or below ambient temperature, and particularly to thermal insulating containers for such materials.

BACKGROUND OF THE INVENTION

Shipment and handling of thermally sensitive commodities, such as pharmaceutical, biomedical and food products, often requires thermally insulated packaging and/or refrigerated transport. For example, there often exists a need in the food industry to thermally insulate frozen, chilled or heated food products. Frozen or chilled meats and seafood, produce, and prepared foods, must be kept cold during transportation to and from processing facilities and to retail markets. Cold or hot prepared foods, such as ice cream or pizzas, must also be maintained at preparation temperature during delivery to individual consumers. Other industries also require thermal insulation of materials during shipment. For example, human blood or tissue must be maintained at a safe storage temperature to prevent degradation during transportation from collection centers to storage or transfusion sites.

Containers for shipping and thermally insulating hot or cold materials conventionally are constructed from rigid molded materials, such as rigid thermoplastic shells filled with insulating materials, or foam polystyrene shells. Such construction is typical of coolers used by individual consumers. However, such rigid coolers have limited thermal retention abilities. Radiant energy in the form of heat is absorbed by the container walls, and then passes through the wall, as limited by the low conductivity of the materials used to construct the container walls. Similarly, radiant energy from hot materials kept in such coolers radiates externally from within the container. Additional heat leakage may occur through joints defined between containers and their lids, which aid in heat transfer to or from the container. While such coolers work well for short periods of time, the ability to safely maintain foods, medical products or other materials at a desired temperature is typically limited to less than eight hours. Such containers are also very large and bulky due to the thickness of the insulating material required to achieve some effective level of thermal insulating ability. Thus, such containers are not suitable for shipping large quantities of materials. Further, once emptied, the containers utilize considerable storage room.

Soft-walled fabric insulating containers have also been developed, typically for use in insulating hot prepared foods during delivery, such as for the delivery of pizza. Such soft-walled containers are much thinner and lighter in weight, compared to conventional coolers. However, their thermal insulating abilities are typically of limited effectiveness, compared even to conventional rigid coolers. These soft-walled containers are typically constructed from fabric materials, such as woven nylon, which are insulated with polyester fiber insulating materials. Radiant energy passes freely through such containers, although the insulation does provide some resistance to conductive heat transfer, dependent on the insulating abilities of the fiber fill. Additional heat leakage occurs through sewn seams and zippers incorporated into such containers. Additionally, such soft-walled containers have no structural rigidity, and thus are floppy and difficult to use when loading and unloading materials. Further, the walls of such containers tend not to be impervious to vapors and liquids, permitting leakage of materials stored within the containers or, potentially, contamination of stored materials with water or other liquids from the outside. The fabric used to construct these containers is also prone to abrasion and wear.

Some soft thermal containers have been developed which include a single layer of radiant energy reflective material on the inside of the container. This single layer of reflective material aids in prevention of radiant heat energy flow into or out of the interior of the container, but does not prevent passage of such radiant energy through the insulation of the container wall. Thus, while inclusion of a single reflective layer is an improvement over other conventional soft thermal containers, the overall thermal efficiency of these containers is still limited. Further, additional shortcomings of soft thermal containers, such as leakage through seams and zippers, floppy construction, poor wear characteristics, and the use of liquid and vapor permeable materials, are still present.

There also exists a need for thermal insulating containers which include tamper-evident seals, particularly for shipment of foods and medical products. Such seals are useful to insure that the integrity of the materials contained within the containers has not been compromised during shipment.

SUMMARY OF THE INVENTION

The present invention provides a collapsible thermal insulating container. The container has a bottom wall, a side wall, and a top wall. The walls are assembleable to define an interior compartment, and are disassembleable to lie flat. Rigidizing structure is incorporated with the side wall to render the assembled container self-supporting. Each wall defines an inner surface and an outer surface. At least a first radiant energy reflective layer defines one of the inner surface or the outer surface. Each wall also includes an air trapping thermal insulation layer.

In a preferred embodiment, the walls of the container are constructed from inner and outer reinforced, radiant energy reflective layers. A multilaminate closed cell insulating foam layer is included between the reflective layers. A rigid sheet may also be included between the reflective layers to provide the container with self-support.

In a preferred embodiment, the container is formed from a single sheet of hinged panels, which are assembled by folding the sheet into a box-like configuration and joining the panels utilizing mating hook and loop fastener strips secured thereon.

The present invention thus provides a collapsible soft-walled thermal insulating container. Each wall is formed from a thermal matrix that is highly efficient in preventing both radiant energy and conductive heat transfer. Because the container is collapsible to a flat configuration, collapsed containers can be stacked and stored without utilization of large space. Because of the materials utilized in the construction, the container is extremely thermally efficient, impervious to liquids and vapors, very lightweight yet strong, and is resistant to wear.

BIREF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
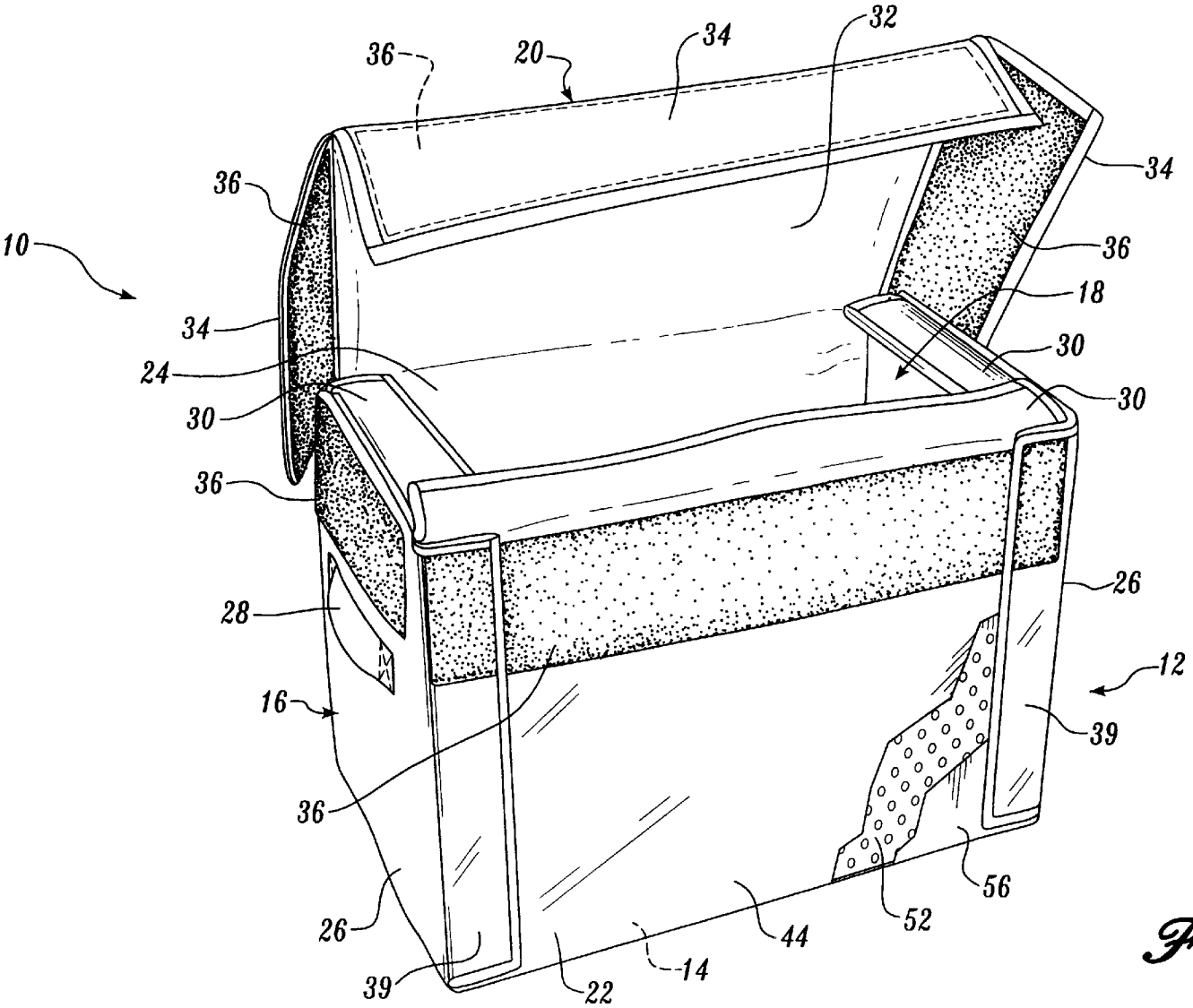
FIG. 1 is a pictorial view of an assembled container constructed in accordance with the present invention, with the lid shown partially opened.

A container 10 constructed in accordance with the present invention is illustrated in FIG. 1 in the assembled configuration. The container includes a base 12 defined by a rectangular bottom wall 14 surrounded on its perimeter by an upwardly projecting side wall 16. The upper edge of the side wall 16 defines an aperture 18 for receiving goods to be stored in the container. The container further includes an integral lid 20 which is hingedly connected along an edge to an upper edge of the side wall 16, and which can be selectively lifted into the open configuration shown in FIG. 1 or to a closed configuration (not shown).

In the preferred configuration illustrated, the container 10 has a parallelepiped shape. Referring still to FIG. 1, the side wall 16 has a hinged front portion 22 which projects upwardly and perpendicularly from a forward edge of the bottom wall 14. The side wall 16 further includes a hinged back portion 24 which projects upwardly and perpendicularly from a back edge of the bottom wall 14. The side wall 16 further includes first and second end portions 26 which project upwardly and perpendicularly from left and right edges of the bottom wall 14, and which span from the front portion 22 to the back portion 24 on each side of the container. Each end portion 26 is provided with a handle 28 for lifting the container 10.

The aperture 18 of the container 10 is bordered by inwardly projecting elongate inner flaps 30 which are hingedly connected to the side wall 16 and extend slightly upwardly and inwardly into the interior of the container 10 from the upper edges of the front portion 22 and each end portion 26. The lid 20 includes a top wall 32 which is hingedly joined to the upper edge of the back portion 24 of the container, and which covers the aperture 18 when the container 10 is in the closed configuration. The lid 20 further includes sealing flaps 34 that are hingedly coupled to the top wall 32 along the forward and left and right side edges of the top wall 32. When the lid 20 is closed, the sealing flaps 34 project downwardly and overlap upper edge segments of the front portion 22 and end portions 26 of the side wall 16. Mating hook and loop fastener strips 36 are mounted on the interior of the sealing flaps 34 and in corresponding positions on the upper edge segments of the exterior of the front portion 22 and end portions 26 of the side wall 16. The sealing flaps 34 thus selectively and detachably join with the side wall 16 when the lid 20 is closed against the base 12.

The end portions 26 of the side wall 16 are formed from joined, overlapping panels which extend hingedly from each of the back portion 24, front portion 22 and bottom wall 14, overlap each other, and are joined to each other and the front and back portions 22 and 24 by mating hook and loop fasteners, as shall be described more fully subsequently. Due to this overlapping of the end portions 26, and the overlapping of the sealing flaps 34 on side wall 16, all comers of the closed container 10 are wrapped by hinged portions of the container. Along the upper edges of the aperture 18, where air leakage would potentially be greatest, there is a double hinge overlap provided by the presence of the inner flaps 30 underlying the edges of the top wall 32, and the sealing flaps 34 of the lid 20 overlying the upper edge segments of the side wall 16. Heat leakage through the comers and aperture of the container 10 are greatly reduced by this overlapping construction.

Figure 2:
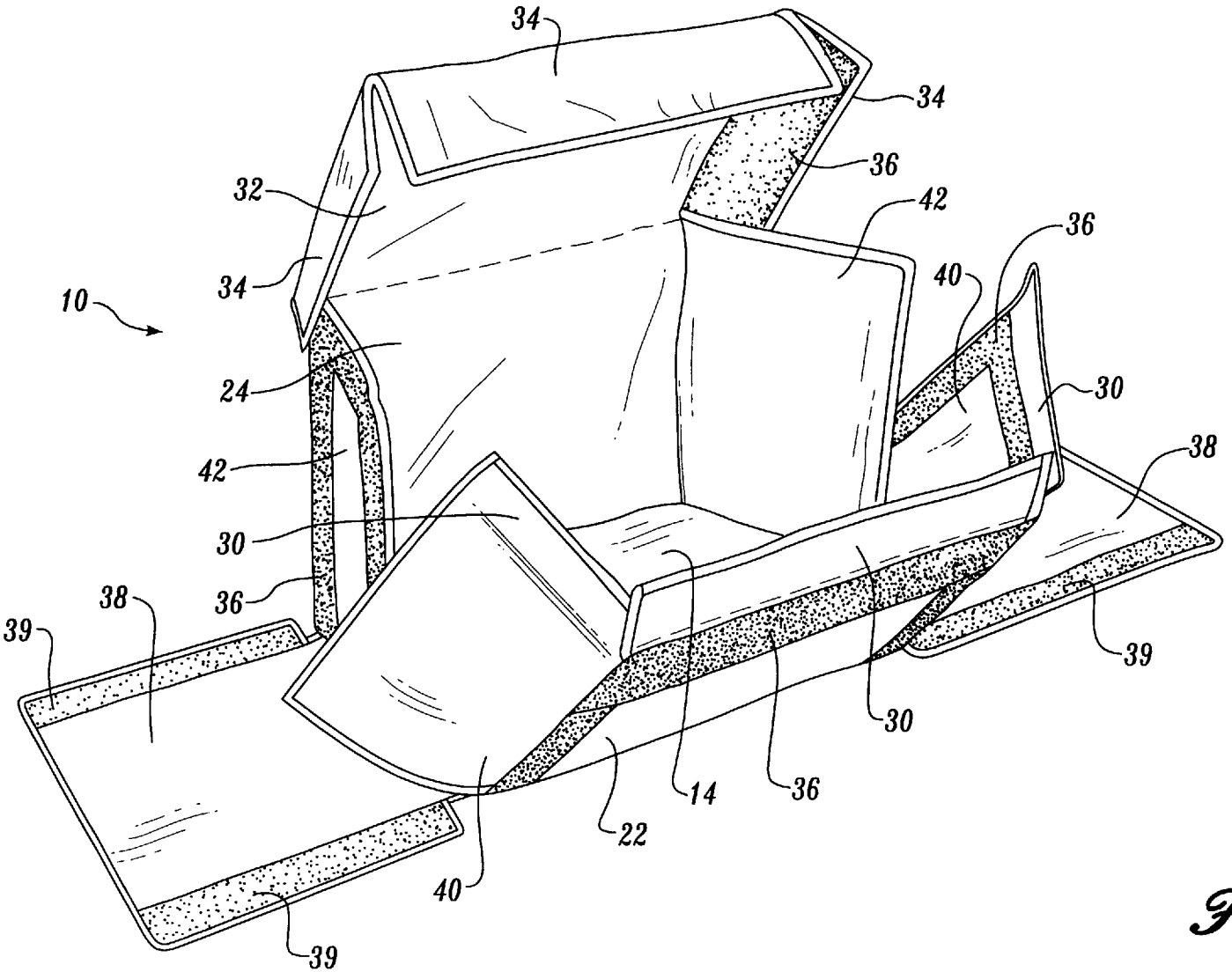
FIG. 2 is a pictorial view of the container of FIG. 1, partially broken down from its assembled configuration.

The container 10 may be broken down or unfolded to a completely flat, disassembled configuration for stacking and storage. Disassembly of the container 10 is illustrated in FIG. 2. The container 10 is opened by lifting the flaps 34 to separate the joined hook and loop fastener strips 36. The container 10 is then broken down by unfolding the end portions 26. Each end portion 26 is formed from overlapped, joined, outer, middle and inner end panels 38, 40 and 42, respectively. The outer end panels 38 are hingedly connected to each of the left and right edges of the bottom wall 14, and in the assembled configuration extend perpendicularly upward therefrom. Each outer end panel 38 includes securement flaps 39 extending from the vertical side edges of the panel. The interior of each securement flap 39 is provided with a hook and loop fastener strip 36. The securement flaps 39 each wrap and overlap a corresponding fastener strip 36 which is sewn on the left and right edges of the front portion 22 and back portion 24. The securement flaps 39 can be peeled outwardly to separate the fastener strips 36, and the outer end panel 38 can then be folded down to lie flat within the plane of the bottom wall 14.

The middle end panel 40 is hingedly connected to the left edge of the front portion 22, and in the assembled configuration projects perpendicularly therefrom. The middle end panel 40 includes a set of fastener strips 36 secured on the inner perimeter edges thereof, which are selectively matable with corresponding fastener strips 36 sewn on the outer perimeter edges of the inner end panel 42. The middle end panels 40 can be pulled outwardly to separate the fastener strips 36 which mate the middle end panels 40 and inner end panels 40 together. At this point, the front portion 22 and hingedly connected middle end panels 40 can be laid flat within the plane of the bottom wall 14. The inner flaps 30 are hingedly connected to the upper edges of the front portion 22 and middle end panels 40, and also will lie flat in this configuration.

The inner end panels 42 project from the left and right side edges of the back portion 24. Once the outer end panels 38 and middle end panels 40 have been removed, the back portion 24 and hingedly connected inner end panels 42, top wall 32 of the lid 20, and sealing flaps 34 all also can be laid down flat in the plane of the bottom wall 14.

Figure 3:
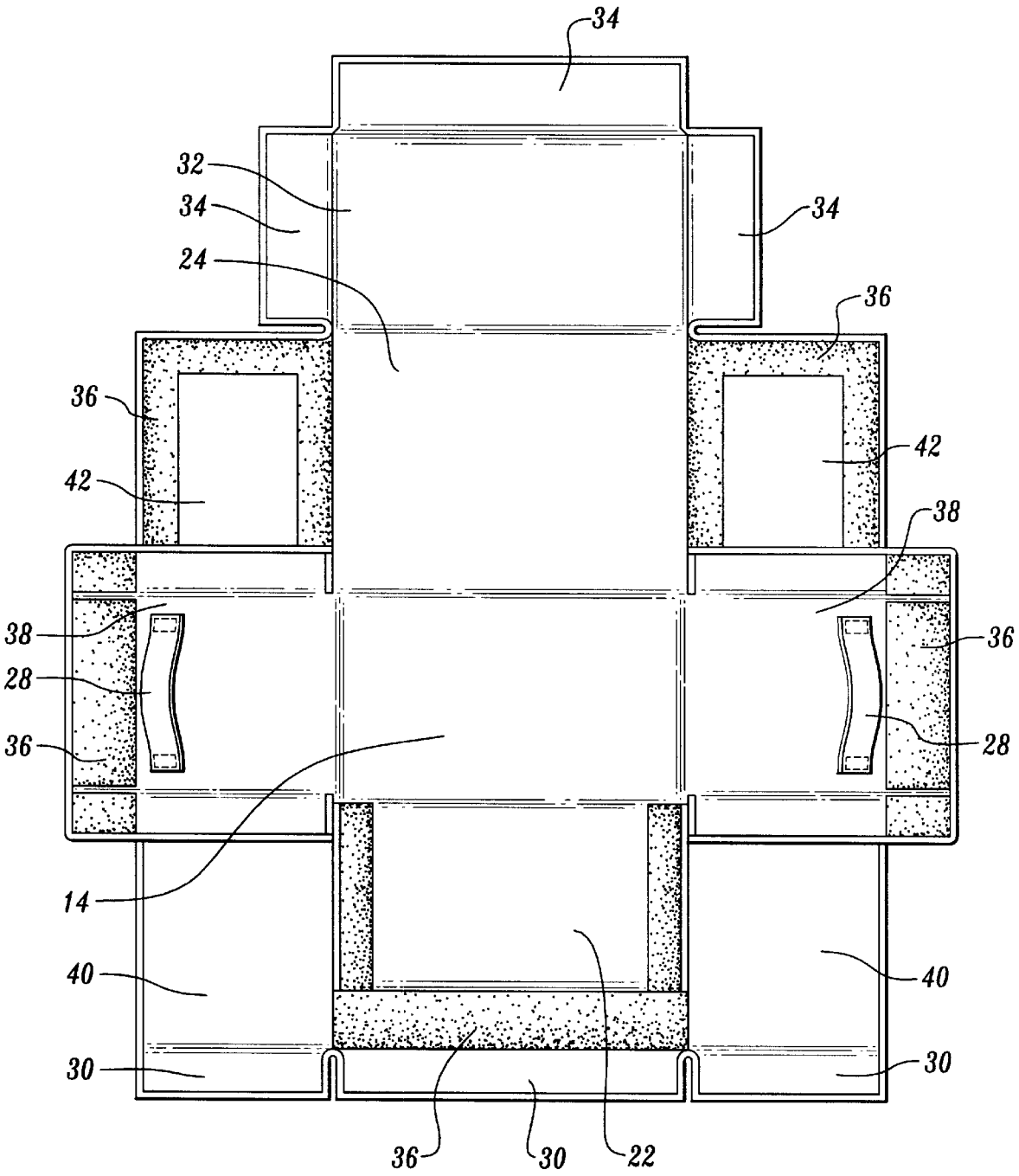
FIG. 3 is a top plan view of the outside of the fully unfolded, broken down container of FIG. 1.
Figure 4:
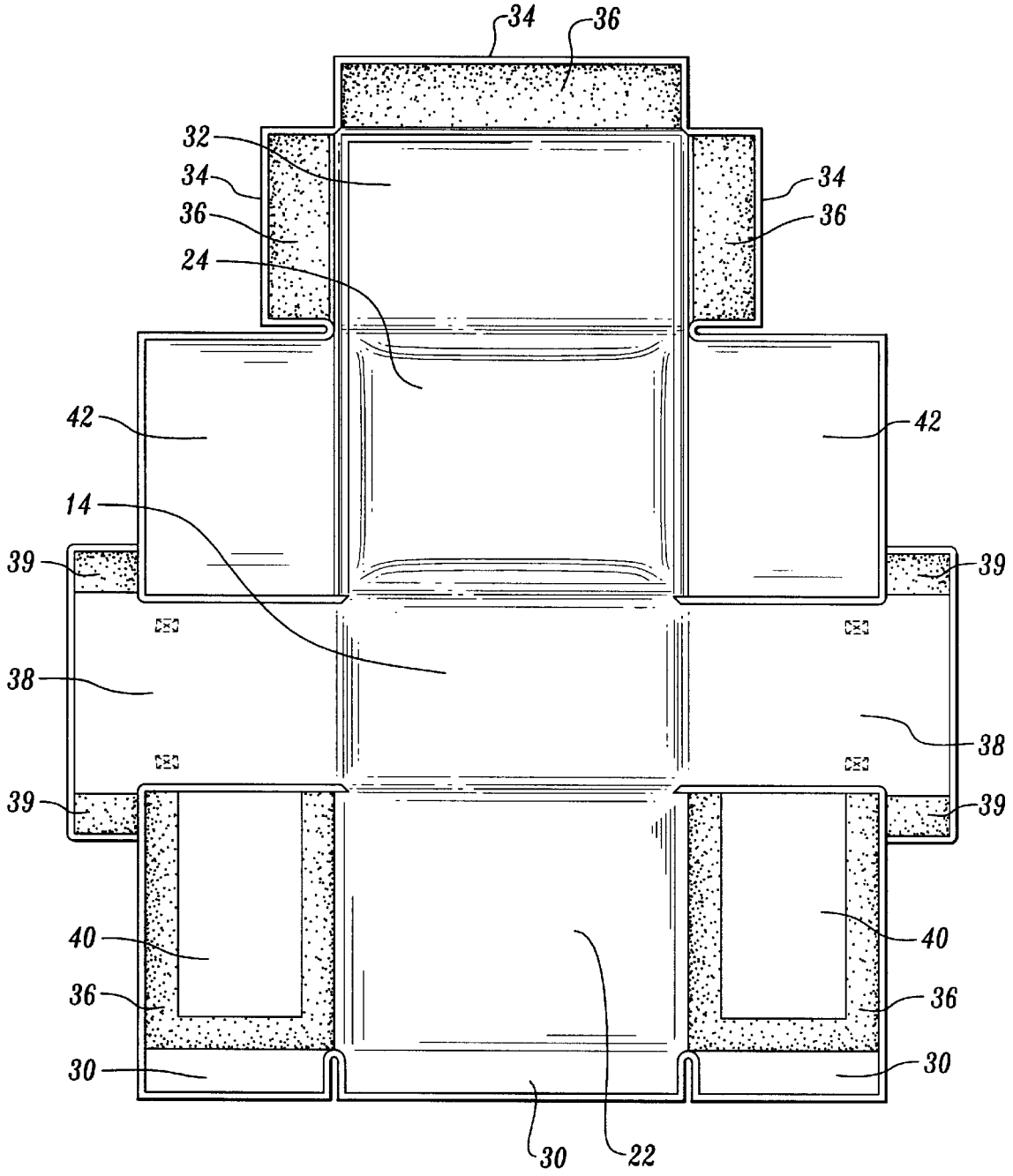
FIG. 4 is a bottom plan view of the fully unfolded, broken down container of FIG. 1.

This fully-disassembled, broken-down, folded-out single piece sheet configuration of the container 10 is illustrated in the plan views of FIG. 3 (which illustrates the outer surface of the container 10) and FIG. 4 (which illustrates the inner surface of the container 10). In this disassembled configuration, the entire container 10 will lie flat within a common plane, for ready stacking and storage.

Figure 5:
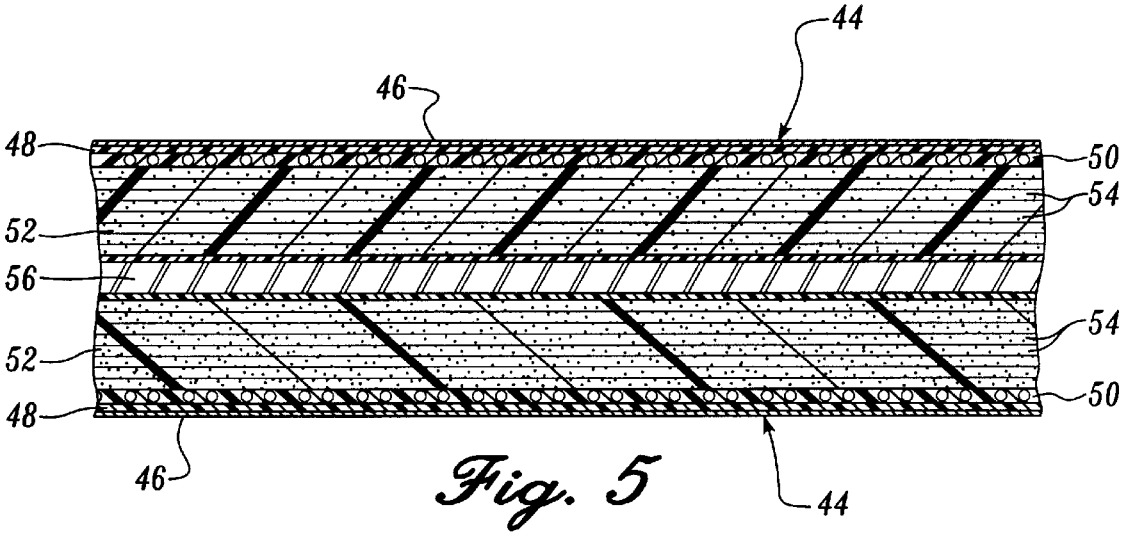
FIG. 5 is a cross-section of the wall of the container taken along a plane oriented perpendicular to the outer surfaces of the container wall.

Construction of the panel walls forming the container 10 will now be described with reference to FIGS. 1 and 5. The inner and outer surfaces of the container 10 are formed from an energy reflective laminate 44. The energy reflective laminate 44 includes an outer radiant energy reflective layer 46. The reflective layer 46 needs to be capable of reflecting radiant heat energy, and preferably is formed from a silvercolored metallic sheet. Suitable reflective materials include thin sheets of shiny aluminum or stainless steel. The reflective layer 46 is bonded by an intermediate layer 48 to a reinforcing layer 50. Suitable materials for the intermediate layer 48 include thermoplastics such as polyester. The reinforcing layer 50 preferably includes a woven fiber scrim embedded within a thermoplastic material. Suitable materials for the reinforcing layer 50 include vinyl thermoplastic reinforced with polyester scrim. Aluminum/polyester scrim reinforced polymer laminates are available which have an R-value of approximately 0.8 and a U-value of approximately 1.3 (Reeves Thermal Test). The utilization of an energy reflective layer 46 on the exterior of the energy reflective laminate 44, and thus on both the exterior and interior surfaces of the container 10, is critical to the present invention. The radiant reflective layer 46 forms a first complete external radiant energy shield about the container 10 on the exterior of the container, as well as a second radiant energy reflective shield on the interior of the container 10. In certain locations of the container 10, this effect is magnified by overlapping panels and flaps of the container 10.

The inclusion of a reinforcing layer 50 in the reflective laminates 44 is also desirable to make the surfaces of the container 10 more wear and abrasion resistant, and to increase the tear strength of the reflective layer 46. The intermediate layer 48 is used when required for bonding the reflective layer 46 to the reinforcing layer.

All walls of the container 10 also includes one or more air trapping insulating layers 52 between the inner and outer energy reflective laminates 44. In the preferred embodiment of the present invention, the air trapping thermal insulating layer 52 utilized is a closed cell foamed polymer. Still more preferably, the insulating layer 52 is a closed cell foamed polymer laminate. Each insulating layer 52 preferably includes multiple plies 54 of thin closed cell foam polymer sheet, which are spot heat-welded together to form a laminate. Each individual ply 54 of the insulating layer 52 includes a plurality of air bubbles which trap air and thereby provide thermal conductivity heat transfer resistance. Minute layers of air are also trapped between the individual plies 54, which provide further heat resistance. The accumulative effect of the multiple plies 54 of the insulating layer 52 is to magnify the heat transfer resistance.

Suitable laminated closed cell foam for the insulating layer 52 is a closed cell microfoamed polypropylene, laminated with four or eight individual plies heat welded spotwise together. Suitable material that is commercially available includes high pressure extruded, closed cell, cross-linked polypropylene foam having an average of approximately 50,000 microcells/in$^3$. Such material has a thermal conductivity of 0.27 BTU/Hr.ft$^2$/°F./inch, a one inch thermal resistance of at least 3.0 and preferably 3.7 Hr/ft2/°F./BTU, and a density of approximately 0.7 lb./ft$^3$.

Each of the bottom wall 14, front portion 22, back portion 24, top wall 32, end panels 38–42, sealing flaps 34, and inner flaps 30 include inner and outer energy reflective laminates 44 and at least one insulating layer 52. The thickness of the insulating layer 52 and the number of insulating layers 52 vary depending on location. Thus, for example, multiple insulating layers 52 of a first thickness may be utilized in the non-overlapped front portion 22, back portion 24, bottom wall 14, and top wall 32. A single insulating layer 52 or insulating layers 52 of reduced thickness may be utilized in the overlapping end panels 38, 40 and 42, and the flaps 30 and 34.

The walls of the container 10 also preferably include structure to lend the individual panels a degree of semi-rigidity so that the container 10 is self-supporting in the assembled configuration. Thus, the walls may include a substantially rigid structural reinforcement layer 56. Suitable materials for the structural reinforcement layer 56 are lightweight, such as corrugated plastic board. The structural reinforcement layer 56 is preferably included in the bottom wall 14, front portion 22, back portion 24, top wall 32 and at least one of the end panels 38 through 42 on each side of the container 10. The use of corrugated plastic board for the structural reinforcement layer 56 also provides additional thermal insulation due to the air trapped within the corrugations.

The combined thermal matrix of the outer energy reflective laminate 44, one or more insulating layers 52, structural reinforcement layer 56, and the inner energy reflective laminate 44 is highly effective at preventing both radiant energy and conductive heat transfer. In the preferred embodiment of the invention, the walls of the container 10 have an overall cumulative insulating factor (R- value) of greater than 10, preferably greater than 15, and most preferably at least 16 (as determined by Model SB2). The container 10 has a useful temperature range of −40° F. to 120° F.

All of the walls of the container 10 are soft and compliant, being constructed from flexible materials, except for the limited degree of rigidity provided by the structural reinforcement layer 56 to render the container self-supporting. The container is also extremely lightweight in construction.

The container 10 is most suitably formed using a single, unitary sheet of energy reflective laminate 44 for the outer surfaces of all panels, and a second single, unitary energy reflective laminate 44 for the inner surface of all panels. These sheets are cut and slitted to size. The hook and loop fasteners 36 and handles 28 are sewn onto the respective energy reflective laminates 44. The insulating layers 52 and structural reinforcing layers 56 are cut to the appropriate size for each panel and are stacked and positioned within the inner and outer energy reflective laminates 44. The laminates are then sewn together adjacent to the edges of the stacked insulating and reinforcing materials to form the hinged joints in the container 10. The edges of the container 10 are suitably bound by sewing a binding strip thereto.

This method of sewing together the materials is preferable because it maintains air space between each of the individual layers of the wall. However, other methods of joinder could be used, as is well known to those of ordinary skill in the art, such as the use of adhesive materials, radio frequency welding, or thermal welding such as by a hot air wheel. It is further noted that the inner flaps 30 of the container underlie the sewn hinged joints of the lid 20, thereby preventing air and radiant energy leakage therethrough.

All of the materials utilized to construct the container 10 are fluid impervious, i.e., do not permit the passage of liquids or vapor. Thus, each of the energy reflective laminates 44, the closed cell foam insulating layers 52, the structural reinforcement layers 56 are fluid impervious.

Figure 6:
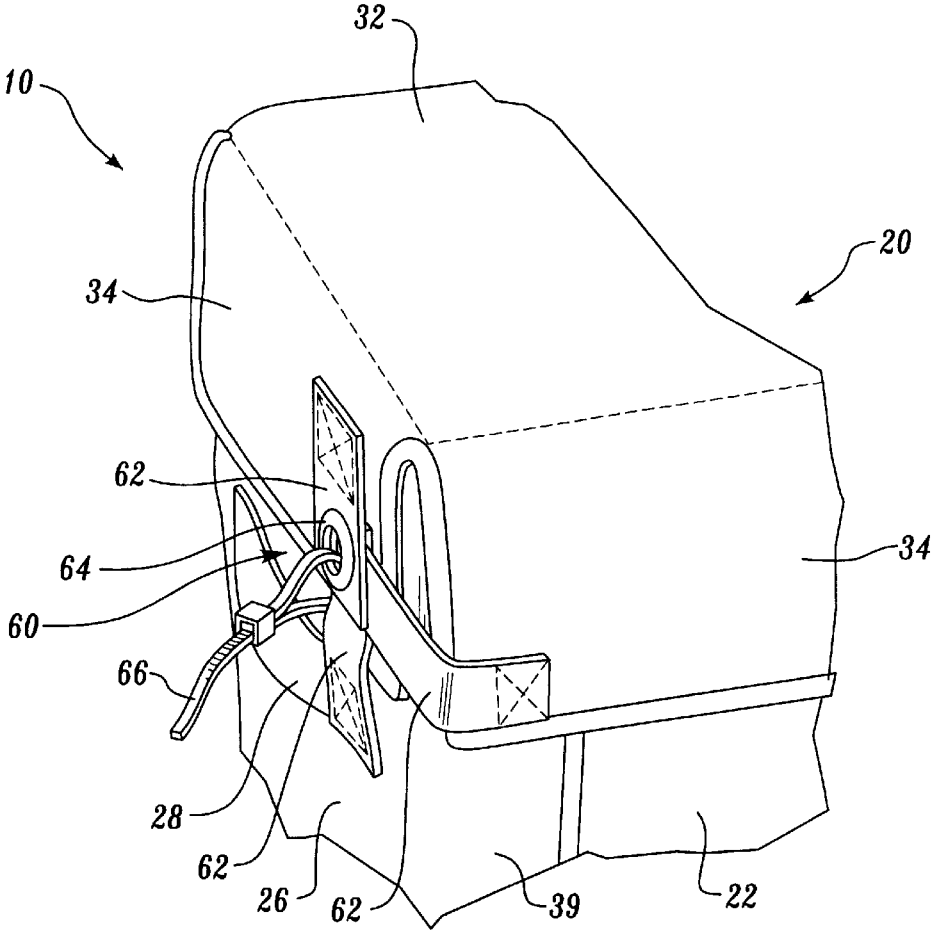
FIG. 6 is a pictorial view of one upper corner of the assembled container of FIG. 1, incorporating a tamper-evident seal.

An alternate embodiment of the container 10 is illustrated in FIG. 6. The container 10 of FIG. 6 is the same as that previously described, but includes structure to permit use of a tamper-evident seal. Each front upper corner of the container 10, one of which is shown in FIG. 6, includes a seal assembly 60. The handle 28 includes a locking strap 62 which is sewn to one end of the handle 30 and side wall 16, and projects upwardly therefrom. The front sealing flap 34 of the lid 20 includes a second locking strap 62 which projects from the lower left corner laterally outward therefrom, which can be bent to fold over the locking strap 62 from the handle 28. A third locking strap 62 is sewn onto the forward corner of the left sealing flap 34, and extends downwardly to overly the overlapped ends of the other two locking straps 62.

Each locking strap 62 includes an aperture bordered by a grommet 64. Each locking strap 62 and handle 28 is preferably formed from a strong flexible material, such as woven nylon. The grommets 64 of the locking straps 62 overlie each other, and a locking device such as a Nylon™ thermoplastic tie wrap 66 can be threaded through the aligned grommets 64 and locked in place. In order to open the locked container 10, the seal must be destructed by either cutting the tie wrap 66, cutting the locking strap 62, or otherwise destroying the walls of the container. Thus, tampering with the container will be evident by such destruction.

EXAMPLES

The following Examples I, II and III provide the results of thermal insulation tests conducted using thermal insulating containers constructed in accordance with the preferred embodiment of the present invention described above.

Example I

Bags of whole blood (one unit each) were allowed to come to equilibrium in refrigerated storage at 30° F. Thirty-three blood units were positioned within the container of the present invention and surrounded by freezer gel packs (−10° F. type). Two gel packs were placed on the bottom of the bag below the blood units, two gel packs were placed on top the blood units, and an additional gel pack was placed vertically on the front side of the container between the container wall and the blood units. Temperature probes were positioned at three elevations within the container, noted as "bottom layer," "middle layer" and "top layer." The container was closed and placed in an ambient environment of 80° F. Internal container temperatures as measured by the probes were monitored and recorded by a computer at 30-minute intervals for a period of 45 hours. During this period of time, the ambient temperature gradually increased to a high of approximately 87° F. The temperature within all monitored locations of the container was maintained at less than 40° F. for approximately 20 hours, and at less than 50° F. for approximately 28 hours.

Example II

The container of the present invention was tested for protection of frozen foods in a warm shipping environment. A first paperboard box, containing eight-ounce bags of frozen cream of broccoli soup, was placed on top of a second paperboard box, containing four-ounce bags of frozen rice with almonds, within the container. This product substantially filled the container. Three thermocouple probes were positioned within the container. A first probe was positioned within the interior of the box of frozen rice with almonds, just below the top layer of the product, approximately 0.75 inches from the top of the box. A second probe was placed in the box of cream of broccoli soup, just below the top layer of product, approximately 0.75 inches from the top of the box. A third probe was taped to the top of the upper box containing cream of broccoli soup. The probes were positioned such that the tips of the probes were about 3 inches from a side or end of each box. The container and contents were initially allowed to equilibrate in a freezer at −15° F. The closed container was then placed on wire shelving within a temperature controlled storage environment of 75° F. (ambient) to begin the test. The thermocouple readings were monitored by computer, with data being logged every 15 minutes for a period of 60 hours. At this temperature of 75° F., the container of the present invention maintained the temperature of the frozen rice at below freezing for approximately 50 hours. The cream of broccoli soup was maintained at or below freezing for at least 60 hours. At the end of the 60-hour test, the container was opened and the contents were examined for quality. About 70% of the food in the rice and cream of broccoli soup packages was found to be frozen at the end of the 60-hour period.

Example III

A further test for thermal insulation of frozen food in a warm environment, specifically frozen rice with almonds and frozen cream of broccoli soup, was performed in accordance with the same procedures set forth in Example II. However, in Example III, the ambient storage environment in which the filled container was placed, was maintained at 90° F. At this storage temperature, the probe in the rice with almonds indicated that the temperature was maintained at or below freezing for approximately 42 hours. The probe in the cream of broccoli soup indicated that the temperature of that food product was maintained below freezing for about 54 hours. At the end of the 6-hour test period, examination of the container contents indicated that approximately 10–20% of the food material was still frozen.

While the preferred embodiment of the invention has been illustrated and described, it will be apparent that various changes can be made therein without departing from the spirit and scope of the invention.

The embodiments of the invention in which an exclusive property or privilege is claimed are defined as follow:

1. A collapsible thermal insulating container, comprising:

a bottom wall, side wall and top wall, the walls being assembleable to define an interior compartment and being disassembleable to lie flat;

rigidizing structure incorporated with the side wall to render the assembled container self supporting, and wherein each wall defines an inner surface and an outer surface, and includes;

a first radiant energy reflective layer defining one of the inner surface and the outer surface;

an air trapping thermal insulation layer; and a tamper-evident seal formed by selectively joining means for locking defined on a plurality of the walls, the thereby joined tamper evident seal being necessarily destroyed to open the container.

2. The container of claim 1, wherein the locking means comprise apertures defined in tabs secured to the top and side wall of the container.

3. The container of claim 1 wherein the air trapping thermal insulation layer comprises a microfoamed closed cell polymer.

4. A collapsible thermal insulating container, comprising:

a bottom wall, side wall and top wall, the walls being assembleable to define and interior compartment and being disassembleable to lie flat;

rigidizing structure incorporated with the side wall to render the assembled container self supporting, and wherein each wall defines an inner surface and an outer surface, and includes;

a first radiant energy reflective layer defining one of the inner surface and the outer surface;

an air trapping thermal insulation layer; and wherein the side wall comprises overlapping side wall panel portions that are selectively joined together during assembly of the container, and wherein when assembled at least one end wall portion of the side wall of the container comprises at least three overlapped side wall panel portions, each spanning substantially the entire area of the end wall portion.

5. The container of claim 4 wherein the air trapping thermal insulation layer comprises a microfoamed closed cell polymer.

* * * * *